US006517367B2

(12) United States Patent
Yamane

(10) Patent No.: US 6,517,367 B2
(45) Date of Patent: Feb. 11, 2003

(54) ELECTRICAL CONNECTOR

(75) Inventor: Hiroshi Yamane, Yokohama (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/078,511

(22) Filed: Feb. 21, 2002

(65) Prior Publication Data

US 2002/0115326 A1 Aug. 22, 2002

(30) Foreign Application Priority Data

Feb. 22, 2001 (JP) ..... 2001-046882

(51) Int. Cl.[7] ..... H01R 13/15
(52) U.S. Cl. ..... 439/260; 439/495
(58) Field of Search ..... 439/260, 495

(56) References Cited

U.S. PATENT DOCUMENTS 5,842,883 A * 12/1998 Igarashi et al. ..... 439/260
5,904,586 A * 5/1999 Takayasu ..... 439/260
6,224,418 B1 * 5/2001 Miura et al. ..... 439/260
6,319,052 B1 * 11/2001 Chang ..... 439/495

FOREIGN PATENT DOCUMENTS

JP 11-016643 1/1999

* cited by examiner

*Primary Examiner*—Gary Paumen
(74) *Attorney, Agent, or Firm*—Rader, Fishman & Grauer PLLC

(57) ABSTRACT

An electrical connector for connection of a flat-type connection member is disclosed. The electrical connector comprises a cover adapted to be pivotally moved for opening or closing an opening of a housing. A first and a second contact are retained by the housing in a manner to face into the opening. The first and second contacts are press-inserted from a rear side of the housing into corresponding fixing holes so as to be fixed therein. The first and second contacts each include a lead exposed from the rear side of the housing. The leads of the first and second contacts are arranged in a zigzag fashion as alternately shifted forwardly and rearwardly relative to each other.

6 Claims, 9 Drawing Sheets

ELECTRICAL CONNECTOR

CROSS REFERENCE TO RELATED APPLICATION

This application claims the benefit under 35 U.S.C. § 119 of Japanese Patent Application No. 2001-46882, the abstract of disclosure of which is incorporated herein by reference.

BACKGROUND OF THE INVENTION

1. Field of the Invention

The present invention relates to an electrical connector used for connection of a flat-type connection member for a flexible flat cable generally called FPC (Flexible Printed Circuit) PCB (Printed Circuit Board) and the like.

2. Description of Related Art

As the connector of this type, there has conventionally been known one which includes a synthetic-resin housing having an opening; a plurality of fork-shaped contacts each having a fixing piece and a resilient piece in vertically opposed relation, the fixing pieces and resilient pieces arranged in a manner to face into the opening of the housing; and a synthetic-resin cover adapted to be pivotally moved for opening or closing;the opening of the housing.

More recently, there has been a demand for a connector increased in the number of contacts and further decreased in size. Hence, it is a general practice to provide contacts press-inserted in the housing from the rear side thereof and contacts press-inserted therein from the front side thereof, the contacts inserted from rear including lead portions located on the rear side of the housing, the contacts inserted from front including lead portions located on the front side of the housing. The lead portions are soldered to the board.

In general, the contact inserted from front must have a structure that a rearmost portion thereof is press-inserted. In this structure, the contact is prone to be dislocated. In order to prevent the dislocation of the contact, the contact is formed with an extension portion at its front end, the extension portion extended downward in the form of an inverted T and defining the lead portion at its front part. On the other hand, the contact has a rear part of its extension portion engaged with a front edge of the housing, so as to be retained with an increased strength. In this structure, a part of the contact is interposed between the housing and the board and hence, the demand for the slim design of the connector is not satisfied.

It is an object of the invention to provide an electrical connector featuring a compact, slim design and achieving an increased packaging density.

SUMMARY OF THE INVENTION

In accordance with a preferred embodiment of the invention for achieving the above object, an electrical connector for connection of a flat-type connection member comprises an insulative housing having an opening; a first and a second contact retained by the housing in a manner to face into the opening; and a synthetic-resin cover pivotally movable about a predetermined axis between an open position and a close position to press the connection member against the contacts. The housing has a first and a second fixing hole for fixing the first and second contacts therein, respectively, whereas the first and second fixing holes are extended from a rear side of the housing to the opening thereof. The first and second contacts are press-inserted from the rear side of the housing into the corresponding fixing holes. The first and second contacts each include a lead exposed from the rear side of the housing whereas the leads of the first and second contacts are arranged in a zigzag fashion as alternately shifted forwardly and rearwardly relative to each other.

According to the embodiment, there is provided a sufficient space between the adjoining leads for soldering the leads to the board. As a result, the adjoining contacts may be positioned closer to each other (at a so-called smaller pitch), contributing to the size reduction of the electrical connector. In addition, this permits the board to be increased in the packaging density of conductive portions thereof to be connected with the leads.

Furthermore, since both the first and second contacts are designed to be press-inserted from the rear side of the housing, the contacts may be retained by the housing substantially at longitudinally central portions thereof. Thus, the demand for the slim design of the electrical connector is satisfied while the contacts can be rigidly held to the housing.

DETAILED DESCRIPTION OF THE PREFERRED EMBODIMENT

A preferred embodiment of the invention will be described with reference to the accompanying drawings.

Figure 1:
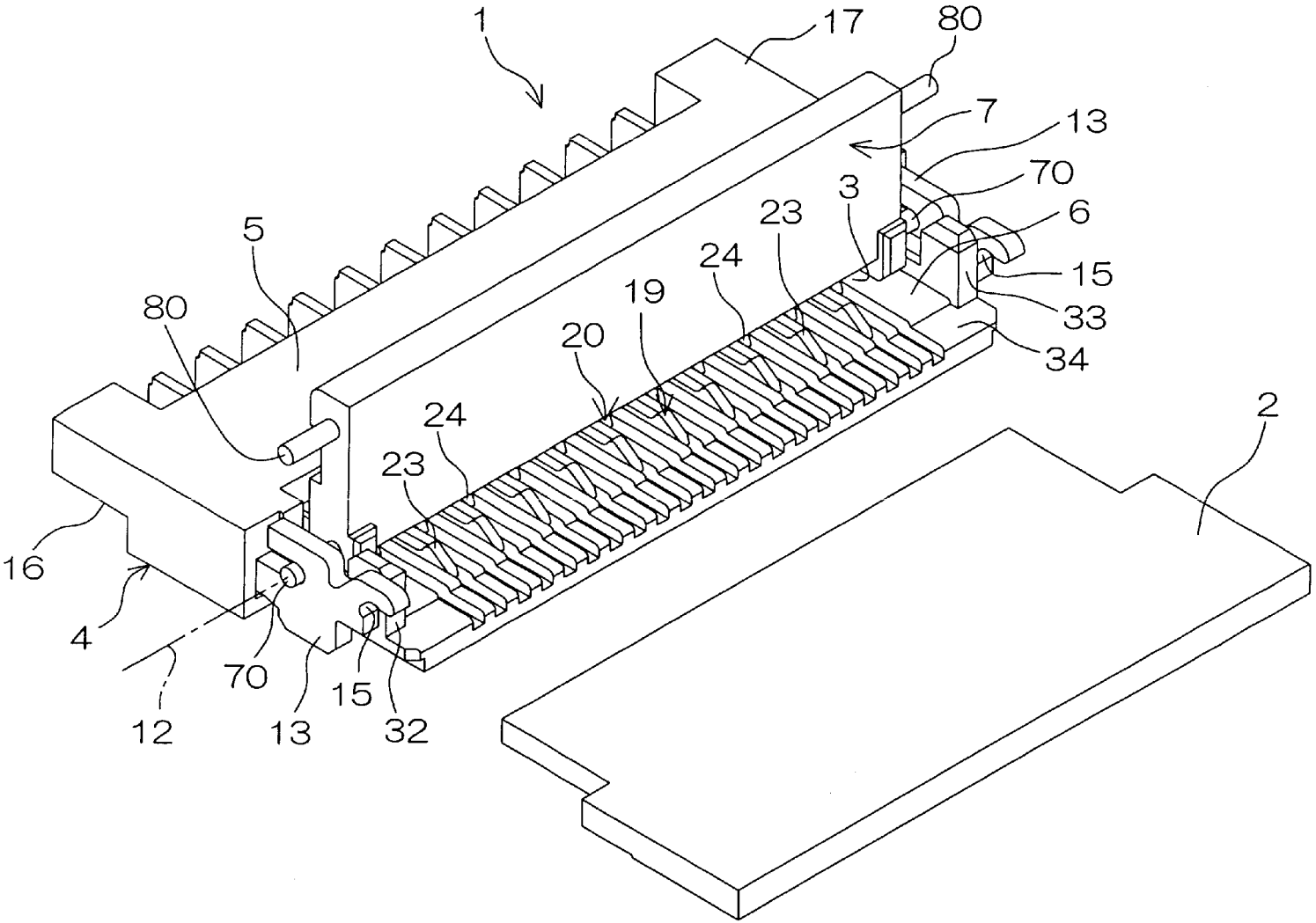
FIG. 1 is a disassembled perspective view showing an electrical connector according to one embodiment of the invention and a connection member.
Figure 2:
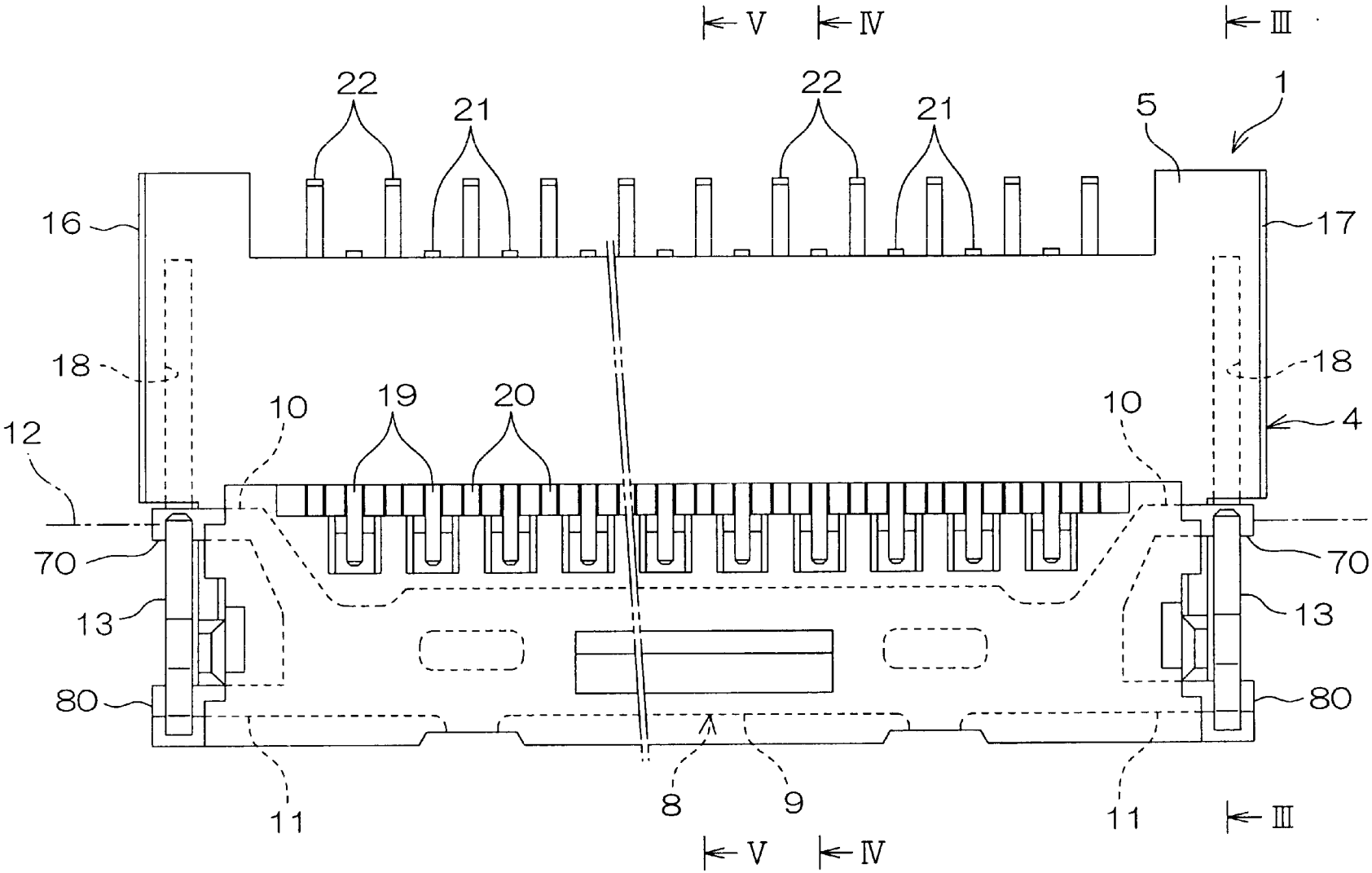
FIG. 2 is a partially cut-away plan view showing the electrical connector with a cover closed.

Now referring to FIGS. 1 and 2, an electrical connector 1 according to one embodiment of the invention comprises a housing 4 formed from an insulative synthetic resin material and defining an insertion space 3 in which a connection member 2 for FPC (Flexible Printed Circuit) or the like is removably inserted from a front side thereof. A fore half part of the housing 4 is open upward via an opening 6 of an upper plate section 5. The housing 4 is pivotally provided with a cover 7 which is formed from an insulative synthetic resin material and pivotally moved to open or close the opening 6.

The cover is reinforced with a metal plate 8 such as formed of a sheet metal material. The plate 8 includes a body portion 9 to be embedded in the cover 7 in the forming process thereof. The body portion 9 is in the form of a transversely elongated rectangle. The body portion is formed with a pair of angle-shaped projections 10 extended from opposite sides of its rear edge in diagonally rearward directions and then in transverse directions, and is also formed with a pair of projections 11 extended from opposite sides of its front edge in transverse directions. Distal ends of the former pair of projections 10 are exposed from transversely opposite sides of the cover 7, defining a pair of pivotal shafts 70 extended along a pivotal axis 12 of the cover 7. The pivotal shafts 70 are each supported by a guiding support portion 14 as allowed to pivot and slide back and forth, the guiding support portion formed at a metallic reinforcement plate 13 fixed to the housing 4.

On the other: hand, the latter pair of projections 11 are also exposed from transversely opposite sides of the cover 7, defining a pair of locking engagement portions 80. The engagement portions 80 are engaged with corresponding lock portions 15 formed at the respective reinforcement plates 13 (hereinafter, also referred to as "reinforcement tabs 13") thereby locking the cover 7 in a close position.

The plate 8 is formed of a sheet metal material whereas the projections 10, 11 are formed into a circular shape in section in the sheet metal working process. Thus, the pivotal shafts 70 and engagement portions 80 also have a circular shape in section so as to smoothly slide on the guiding support portions 14 and the lock portions 15.

Opposite side plates 16, 17 of the housing 4 define lateral sides of the insertion space 3. Fixing holes 18, in paired relation,: open into respective front end faces of the side plates 16, 17 (not shown in FIG. 1 but illustrated in FIG. 2 and FIG. 3 which is a sectional view taken on the line III—III in FIG. 2). The fixing holes 18 receive the reinforcement plates 13 from front sides thereof for fixing the plates 13 therein.

In the housing 4, a plurality of first and second contacts 19, 20 are retained in the insertion space 3 in a manner to face into the opening 5. The first and second contacts 19, 20 are press-inserted from the rear side of the housing 4 into corresponding fixing holes to be fixed therein (see FIGS. 4 and 5). The contacts are arranged in two rows in zigzag configuration as alternately shifted forwardly and rearwardly relative to each other.

More specifically, as shown in FIG. 2, lead portions 21, 22 of the first and second contacts 19, 20 are exposed rearwardly of the housing 4 and arranged in a zigzag fashion as alternately shifted forwardly and rearwardly relative to each other. The lead portion 21 of the first contact 19 is located forwardly relative to the lead portion 22 of the second contact 20.

Similarly, as shown in FIG. 1, contact portions 23, 24 of the first and second contacts 19, 20 to be connected with the connection member 2 are also arranged in a zigzag fashion as alternately shifted forwardly and rearwardly relative to each other. The contact portion 23 of the first contact 19 to be connected with the connection member 2 is located forwardly relative to the contact portion 24 of the second contact 20 to be connected with the connection member 2. The inventive electrical connector is configured as a so-called W-ZIF (Double Zero Insert Force) type connector wherein after inserted into the insertion space 3 with zero insert force, the connection member 2 is pressed against the contact portions 23, 24 of the first and second contacts 19, 20 for ensuring contact pressure.

Figure 3:
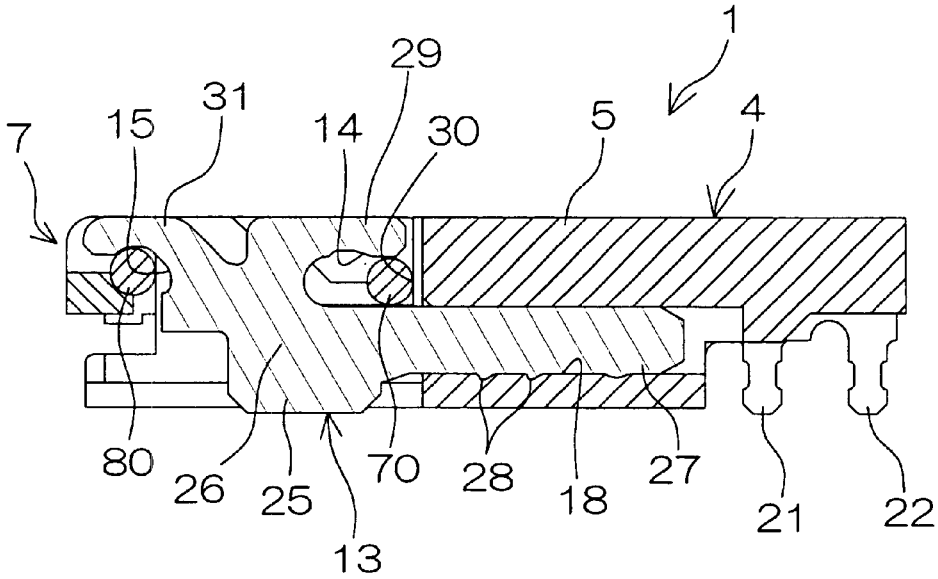
FIG. 3 is a sectional view taken on the line III—III in FIG. 2.

Referring to FIG. 3, the reinforcement tab 13 includes a body portion 26 defining a fixing portion 25, the guiding support portion 14 and the lock portion 15; and an insertion portion 27 extended rearwardly of the body portion 26. The fixing portion 25 is formed at a lower edge of the body portion 26 and soldered to a surface of the board. The insertion portion 27 is inserted from the front side into the fixing hole 18 and fixed therein via locking projections 28.

The guiding support portion 14 comprises an angle-shaped extension piece 29 extended upwardly from a front end of the body portion 26, and a recessed groove defined between the body portion 26 and a position restriction portion 30 of the housing 4. The guiding support portion 14 supports a corresponding pivotal shaft 70 in a manner to allow for a slidable movement of the shaft between a forward position shown in FIG. 10A and a rearward position shown in FIGS. 3 and 10B as well as for a pivotal movement thereof.

The lock portion 15 is defined by a bent extension piece 31 extended upwardly and forwardly from a front end of the body portion 26. The lock portion 15 is shaped like a recessed groove. When the cover 7, having been closed, is slidably moved rearwardly (that is, when the pivotal shaft 70 is shifted to the rearward position), the lock portion 15 comes into engagement with the engagement portion 80, as shown in FIG. 10B, thereby locking the cover 7 in the close position.

Returning to FIGS. 1 and 2, guide walls 32, 33 upstand from opposite lateral edges of a front portion of a lower plate section 34 of the housing 4. The guide walls 32, 33 engage with lateral edges of the cover 7 for restricting a transverse movement of the cover 7.

Figure 4:
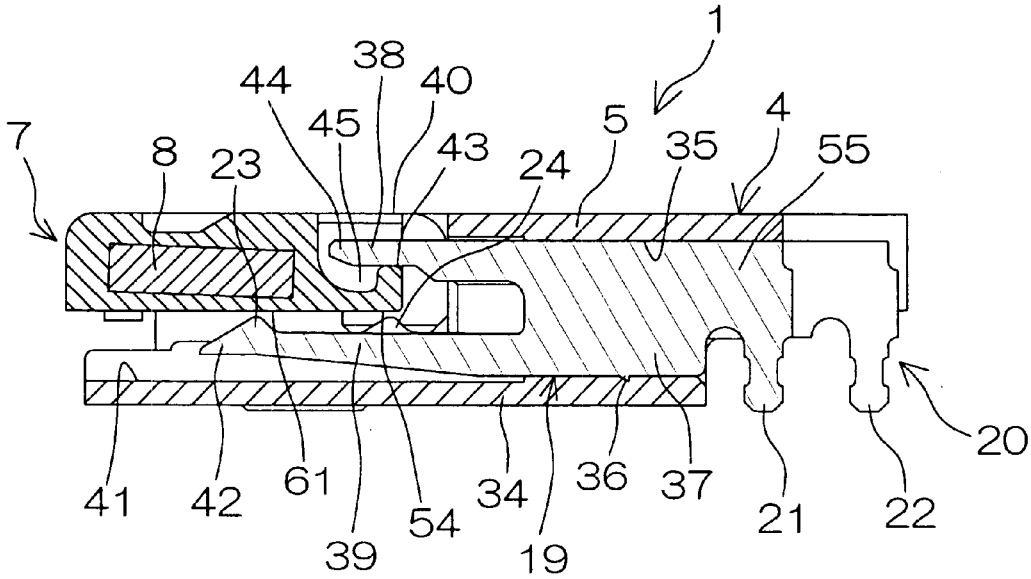
FIG. 4 is a sectional view taken on the line IV—IV in FIG. 2.

Referring to FIG. 4 which is a sectional view taken on the line IV—IV in FIG. 2, the first contact 19 comprises a metal member and is inserted from the rear side into the insertion space 3 of the housing 4 to be fixed to place. As shown in FIG. 4, the first contact 19 includes a body portion 37 with locking projections 36 which is fixed in a fixing hole 35 of the housing 4; a fixing piece 38 and a resilient piece 39 which are extended forwardly of the body portion 37; and the aforesaid lead portion 21 extended rearwardly of the body portion 37.

A front end 44 of the fixing piece 38 is exposed forwardly from the upper plate section 5 of the housing 4 and extended to place over a guide portion 43 of the cover 7 in the close position, the guide portion 43 defined by a groove formed by carving a rear edge portion 40 of the cover 7. In FIG. 4, a reference numeral 45 indicates a recess adjoining the guide portion 43 of the cover 7. The recess 45 is provided in order to avoid interference with the front end 44 of the fixing piece 38 when the cover 7 is pivotally or slidably moved. A back side of the guide portion 43 defines a pressure portion 54. When the cover 7 is closed and slidably moved rearwardly, the pressure portion 54 is positioned above the contact portion 24 of the second contact 20 so as to press the connection member 2 against the contact portion 24 of the second contact 20 in a state where the guide portion 43 is received by the fixing piece 38. The guide portion 43 also includes a pressure portion 61 defined by a portion located to confront the contact portion 23 of the first contact 19 when the cover in the close position is slidably moved rearwardly, thereby pressing the connection member 2 against the contact portion 23 of the first contact 19.

Returning to FIG. 4, the resilient piece 39 is inserted from the rear side into a receiving groove 41 formed on a top surface of the lower plate section 34 of the housing 4. The body portion 37 supports rear ends of the fixing piece 38 and of the resilient piece 39 in a cantilever fashion. The lead portion 21 is extended downward from a rear end of an extension 55 extended rearwardly from the body portion 37. A front end 42 of the resilient piece 39 is formed with the contact portion 23 defined by an upward angle-like projection for providing contact pressure against the connection member 2.

Figure 5:
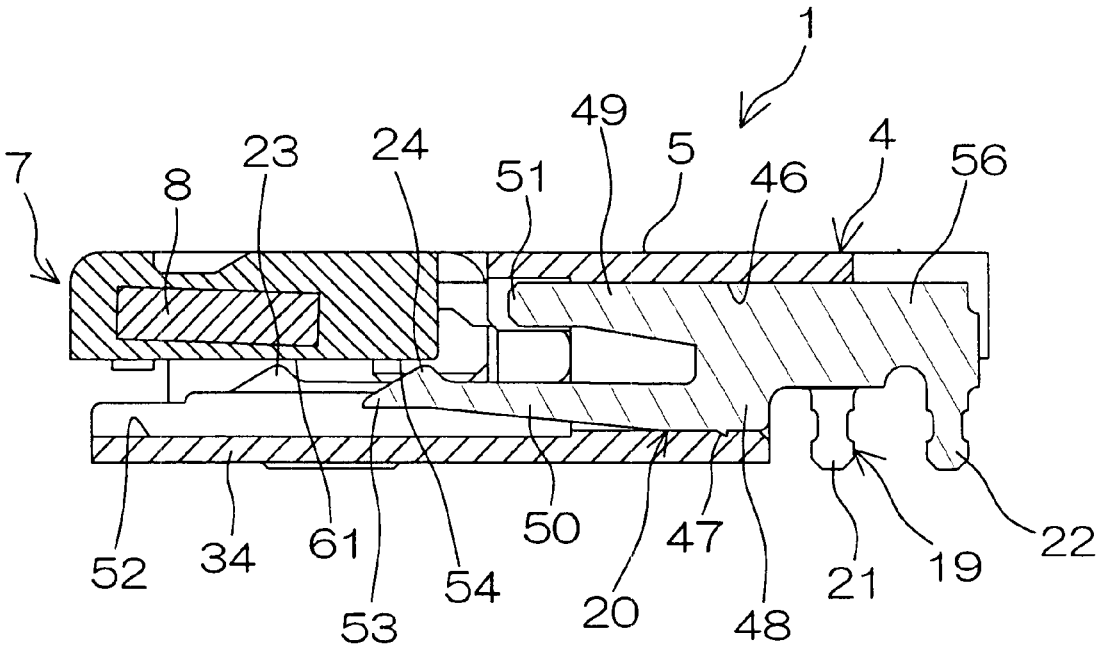
FIG. 5 is a sectional view taken on the line V—V in FIG. 2.

Next, referring to FIG. 5 which is a sectional view taken on the line V—V in FIG. 2, the second contact 20 comprises a metal member which is inserted from the rear side into the insertion space of the housing 4 and fixed to place. The second contact 20 substantially has the same configuration as that of the first contact 19 but differs therefrom in that the second contact is generally disposed rearwardly relative to the first contact 19.

Specifically, the second contact 20 includes a body portion 48 with locking projections 47 which is fixed in a fixing hole 46, of the housing 4; a fixing piece 49 and a resilient piece 50 which are extended forwardly from the body portion 48; and the aforesaid lead portion 22 extended rearwardly from the body portion 48.

A front end 51 of the fixing piece 49 is not exposed forwardly of the upper plate section 5 of the housing 4. In this respect, the second contact 20 differs from the first contact 19.

The resilient piece 50 is inserted from the rear side into a receiving groove 52 formed on the top surface of the lower plate section 34 of the housing 4. The body portion 48 supports rear ends of the fixing piece 49 and of the resilient piece 50 in a cantilever fashion. The lead portion 22 is extended downward from a rear end of an extension 56 extended rearwardly from the body portion 48. A front end 53 of the resilient piece 50 is formed with the contact portion 24 defined by an upward angle-like projection for providing contact pressure against the connection member 2.

Referring to FIGS. 4 and 5, the lead portion 22 of the second contact 20 is located rearwardly relative to the lead portion 21 of the first contact 19 whereas the contact portion 24 of the second contact 20 is located rearwardly relative to the contact portion 23 of the first contact 19.

Figure 6:
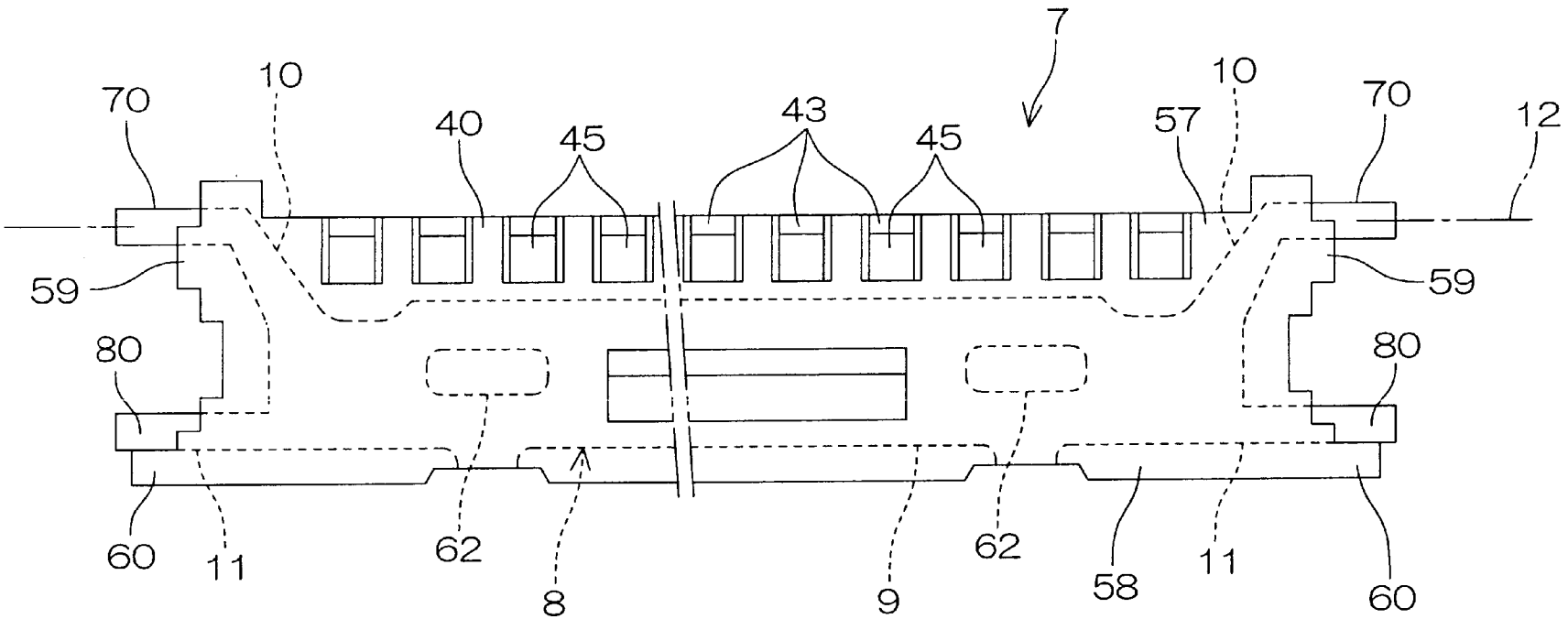
FIG. 6 is a partially cut-away plan view showing the cover.
Figure 7:
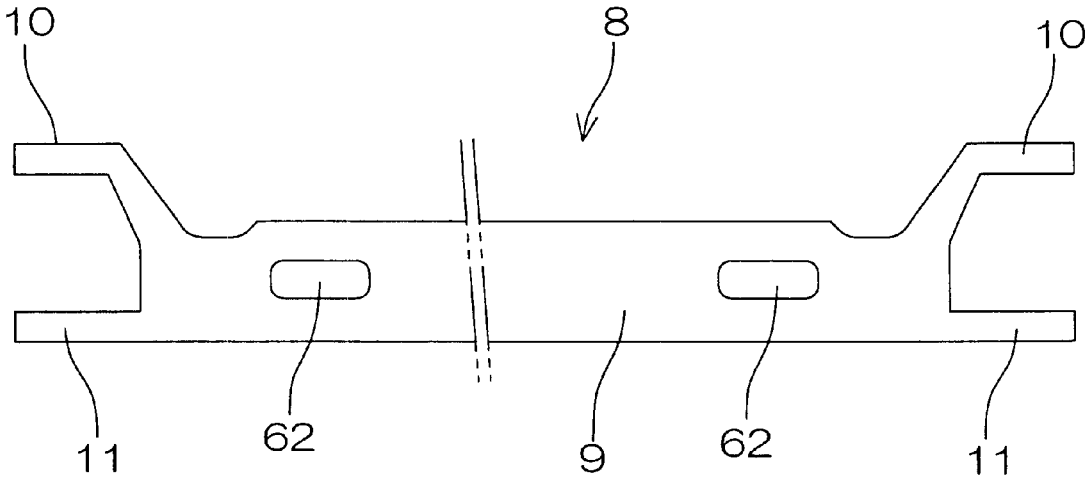
FIG. 7 is a partially cut-away plan view showing a metal plate partially embedded in the cover.

Referring to FIGS. 2 and 6 showing the cover in plan, the cover 7 is in the form of a substantially rectangular plate having a first and a second end 57, 58 in opposed relation. The aforesaid pair of pivotal shafts 70 project from transversely opposite sides 59, 59 of the first end 57 of the cover 7, respectively on the other hand, the aforesaid pair of engagement portions 80 are exposed from transversely opposite sides 60 of the second end 58 of the cover 7, respectively. As mentioned supra, the pivotal shafts 70 and engagement portions 80 are each formed by a part of individual projections 10, 11 of the plate 8 formed of a sheet metal, a most part of which is embedded in the cover 7 in the resin forming process (see FIG. 7). Indicated at 62 are apertures which are formed pairwise, for example, and disposed at transversely spaced places of the body portion 9.

Next, the closing operation and locking operation of the cover 7 will be described with reference to FIGS. 8A–8B and 9A–9B.

Figure 8A:
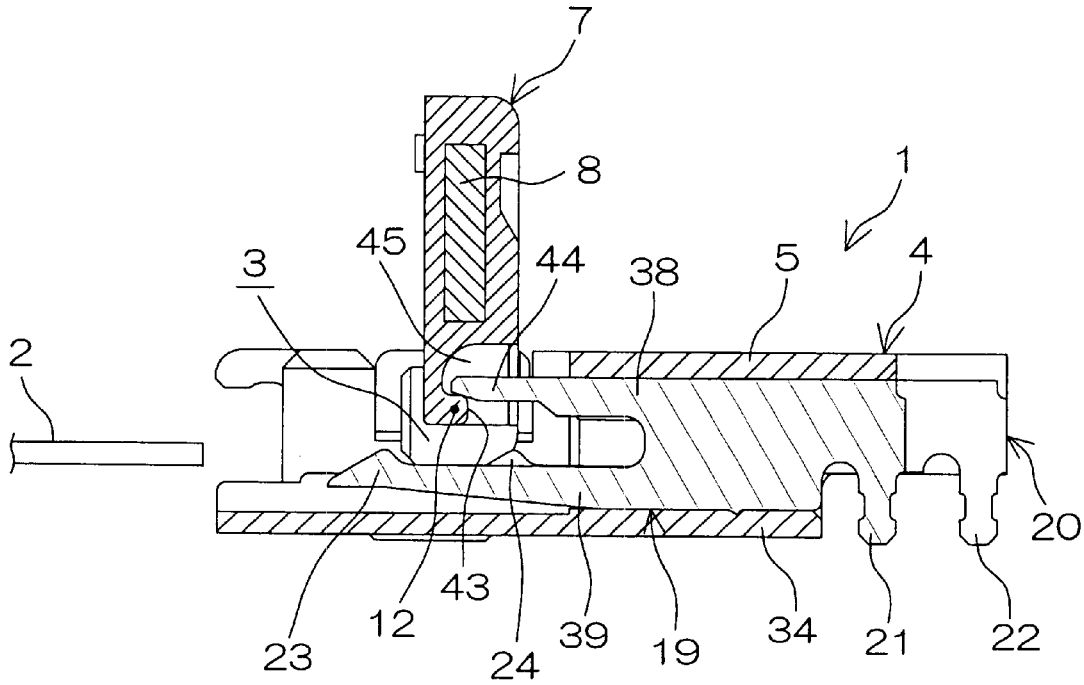
FIGS. 8A and 8B are sectional views showing the electrical connector in correspondence with FIG. 5, FIG. 8A showing a state where the cover is opened whereas FIG. 8B showing a process of closing the cover.
Figure 10A:
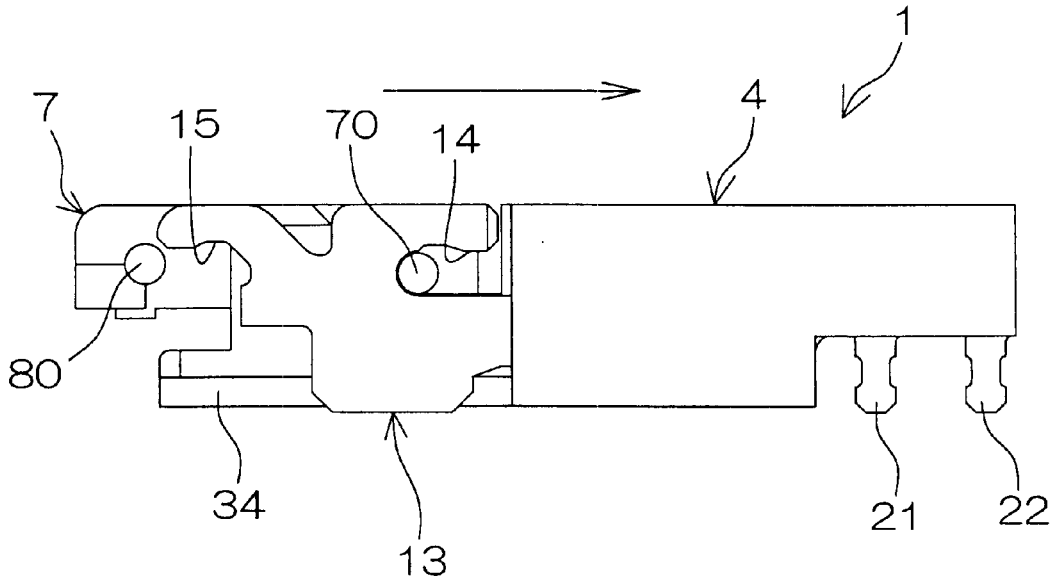
FIGS. 10A and 10B are schematical side views of the electrical connector, FIG. 10A showing a state where the cover is closed with a pivotal shaft located at a forward position whereas FIG. 10B showing a state where the closed cover is slidably moved rearwardly along with the pivotal shaft.
Figure 10B:
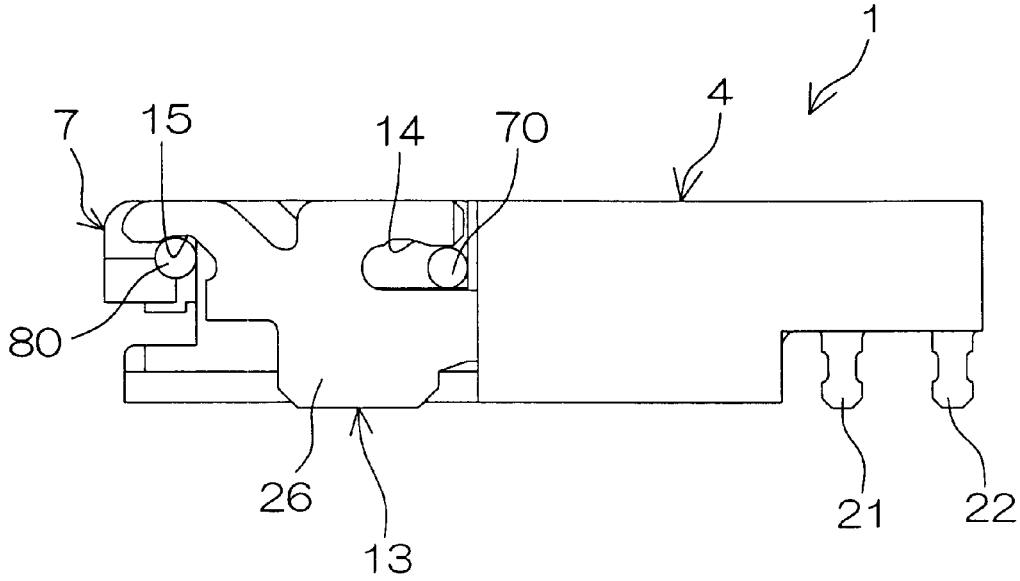

When the cover 7 is in an open position shown in FIG. 8A with the pivotal shaft 70 located at the forward position shown in FIG. 10A, provided above the contact portions 23, 24 of the contacts 19, 20 is the insertion space 3 of a sufficient height which is equal to or greater than a thickness of the connection member 2. Hence, the connection member 2 can be inserted with zero insert force.

Figure 8B:
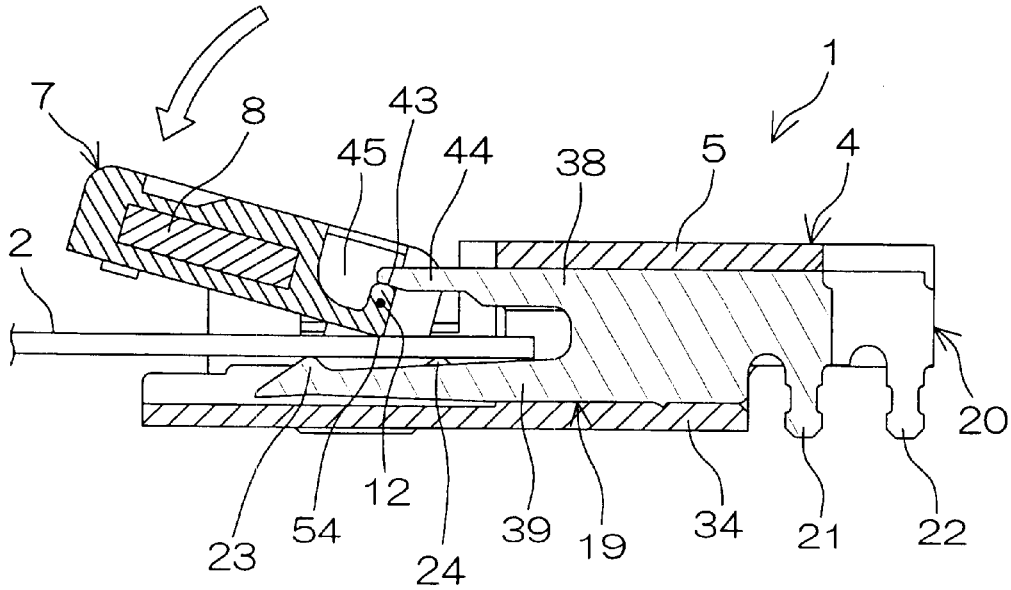
Figure 9A:
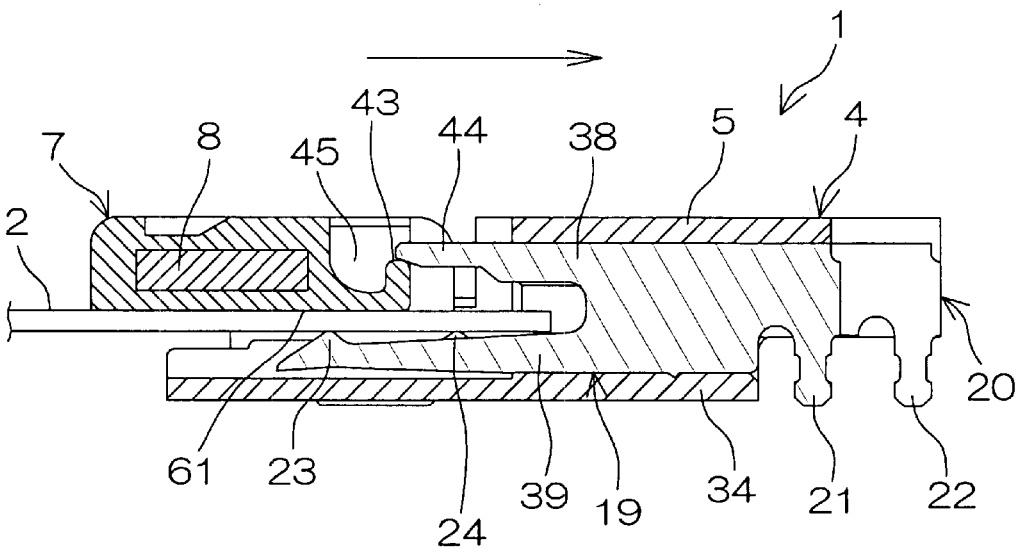
FIGS. 9A and 9B are sectional views showing the electrical connector in correspondence with FIG. 5, FIG. 9A showing a state where the cover is closed whereas FIG. 9B showing a state where the closed cover is slidably moved rearwardly.

After the insertion of the connection member 2, the cover 7 with the pivotal shaft 70 at the forward position is pivoted about the pivotal axis 12, thereby assuming a position shown in FIG. 8B and then a parallel position with respect to the lower plate section 34, as shown in FIG. 9A. This permits the pressure portion 61 of the cover 7 to press the connection member 2 against the contact portion 23 of the first contact 19. However, the connection member 2 is yet to be pushed toward the contact portion 24 at a part thereof on the contact portion 24 of the second contact 20.

Figure 9B:
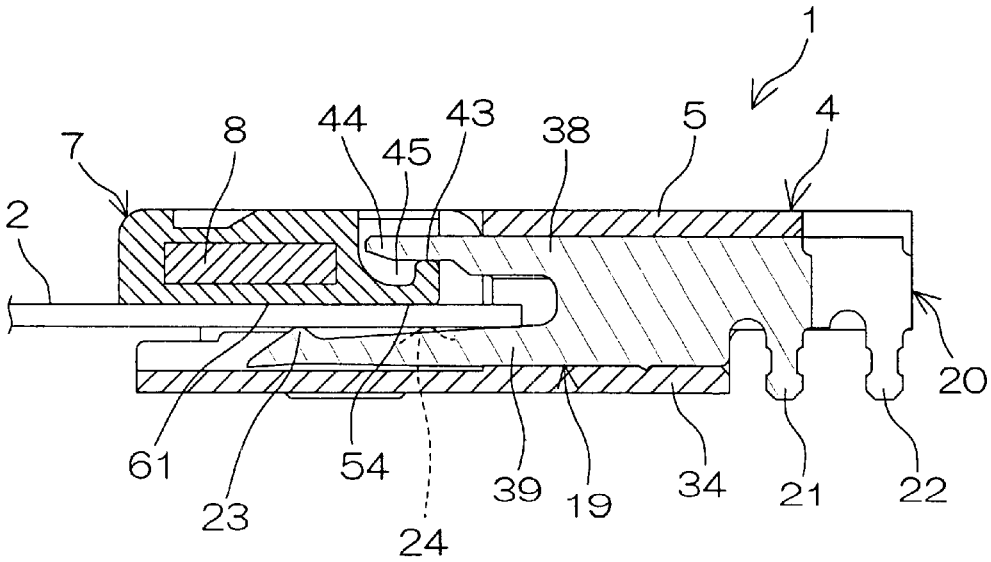

Subsequently when the cover 7 is slidably moved rearwardly as shown in FIG. 9B, the pressure portion 54 of the cover 7 presses the connection member 2 against the contact portion 24 of the second contact 20. At the same time, the engagement portion 80 is slidably moved along a lower side of the extension piece 31, as shown in FIG. 10B, so as to come into full engagement with the lock portion 15. Thus, the cover 7 is assuredly locked in the close position.

According to the embodiment of the invention, there is provided a sufficient space between the adjoining lead portions 21, 22 for soldering the lead portions 21, 22 to the board because the lead portions 21, 22 of the first and second contacts 19, 20 are arranged in a zigzag fashion as alternately shifted forwardly and rearwardly relative to each other. As a result, the adjoining contacts 19, 20 may be positioned closer to each other (at a so-called smaller pitch), contributing to the size reduction of the electrical connector 1. In addition, such an arrangement permits the board to be increased in the packaging density of conductive portions thereof (not shown) to be connected with the lead portions 21, 22. Furthermore, since the contact portions 23, 24 are also arranged in a zigzag fashion as alternately shifted forwardly and rearwardly relative to each other, the connection member 2 is also increased in the packaging density of conductive portions thereof (not shown) to be connected with the contact portions 23, 24.

Furthermore, since both the first and second contacts 19, 20 are designed to be press-inserted from the rear side of the housing 4, the contacts 19, 20 can be retained by the housing 4 substantially at their longitudinally central portions. Thus, the demand for the slim design of the electrical connector is satisfied while the contacts 19, 20 can be rigidly held to the housing 4.

Particularly, the contacts 19, 20 include the pieces 38, 39; 49, 50 at their front parts in the fork-like fashion and the body portions 37, 48 formed with the lead portions 21, 22 at their rear portions and with the locking projections 36, 47, and are press-inserted into the fixing holes 35, 46 of the housing 4. Therefore, the demand for the slim design of the electrical connector is satisfied while the contacts 19, 20 can be rigidly held to the housing 4.

It is to be noted that the invention should not be limited to the foregoing embodiment. For instance, although the above embodiment is arranged such that all of the plural first contacts 19 have the front ends 44 of the fixing pieces 38 thereof extended beyond the rear edge portion 40 of the cover 7, all the front ends 44 should not be extended this way. At least some of the front ends 44 of the fixing pieces 38 may be extended beyond the rear edge portion 40 of the cover 7.

Alternatively, all of the first and second contacts 19, 20 may have the front ends 44, 51 of the fixing pieces 38, 49 thereof extended beyond the rear edge portion 40 of the cover 7 so as to prevent an upward dislocation of the rear edge portion 40 of the cover 7.

The invention is also applicable to the connection of a connection member for FFC (Flexible Flat Cable), PCB (Printed Circuit Board) and the like, instead of that for FPC (Flexible Printed Circuit). The invention is further applicable to a vertical-type electrical connector wherein the connection member is not laterally inserted but inserted from above.

Although the invention has been described in detail with reference to the specific embodiment thereof, changes and modifications thereof as well as equivalents thereto are apparent to those skilled in the art who have fully understood the content hereof. Therefore, it is to be construed that the invention fall within the scope defined by the appended claims and equivalents thereto.

What is claimed is:

1. An electrical connector for connection of a flat-type connection member comprising:

an insulative housing having an opening;

a first and a second contact retained by the housing in a manner to face into the opening; and a synthetic-resin cover pivotally movable about a predetermined axis between an open position and a close position to press the connection member against the contacts, the housing having a first and a second fixing hole for fixing the first and second contacts therein, respectively, the first and second fixing holes extending from a rear side of the housing to the opening thereof, the first and second contacts press-inserted from the rear side of the housing into the corresponding fixing holes, the first and second contacts each including a lead exposed from the rear side of the housing, the leads of the first and second contacts arranged in a zigzag fashion as alternately shifted forwardly and rearwardly relative to each other.

2. The electrical connector as claimed in claim 1, wherein the first and second contacts each include a body portion fixed in each corresponding fixing hole and wherein the body portions of the first and second contacts are each provided with a locking projection locked to each corresponding fixing hole.

3. The electrical connector as claimed in claim 2, wherein the first and second contacts each include a fixing piece and resilient piece extended forwardly from the body portion thereof and vertically confronting each other.

4. The electrical connector as claimed in claim 1, wherein the first and second contacts each include a contact portion for establishing contact with the connection member inserted in the opening, and wherein the contact portions of the first and second contacts are arranged in a zigzag fashion as alternately shifted forwardly and rearwardly relative to each other.

5. The electrical connector as claimed in claim 1, further comprising:

a pair of shafts disposed at a pair of sides of the cover, respectively, and extended along the axis; and a pair of support portions disposed a the housing for supporting the pair of shafts, respectively, in a manner to allow for the pivotal movement of the shafts and slidable movement thereof between a forward position and a rearward position.

6. The electrical connector as claimed in claim 5, wherein when the pair of shafts are at the forward position and the cover is in the open position, formed above the contact portions of the first and second contacts is a connection-member insertion space having a height equal to or greater than a thickness of the connection member.

* * * * *